US009599936B2

(12) United States Patent
Nishisaka et al.

(10) Patent No.: US 9,599,936 B2
(45) Date of Patent: Mar. 21, 2017

(54) IMAGE FORMING APPARATUS HAVING OPPOSITE ROLLER SWITCHING AND IMAGE FORMING SYSTEM

(71) Applicant: Konica Minolta, Inc., Tokyo (JP)

(72) Inventors: Yusuke Nishisaka, Tokyo (JP); Satoshi Nishida, Saitama (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/631,302

(22) Filed: Feb. 25, 2015

(65) Prior Publication Data

US 2015/0277299 A1 Oct. 1, 2015

(30) Foreign Application Priority Data

Mar. 5, 2014 (JP) ..... 2014-042863

(51) Int. Cl.
*G03G 15/00* (2006.01)
*G03G 15/16* (2006.01)

(52) U.S. Cl.
CPC . *G03G 15/1615* (2013.01); *G03G 2215/0135* (2013.01)

(58) Field of Classification Search
CPC ..... G03G 15/1615; G03G 15/1685; G03G 2215/0135
USPC ..... 399/45, 313, 66, 121
See application file for complete search history.

(56) References Cited

U.S. PATENT DOCUMENTS

2008/0310893 A1* 12/2008 Adachi ..... G03G 15/165 399/314
2009/0003895 A1* 1/2009 Yamauchi ..... G03G 15/1675 399/313
2011/0158690 A1* 6/2011 Mimbu ..... G03G 15/1605 399/121
2012/0155897 A1* 6/2012 Torimaru ..... G03G 15/167 399/44

FOREIGN PATENT DOCUMENTS

JP 1998221977 A 8/1998
JP 2004029054 A * 1/2004
JP 2006259576 A 9/2006
JP 2006-267486 A 10/2006
JP 2007322794 A 12/2007
JP 2012-128229 A 7/2012
(Continued)

OTHER PUBLICATIONS

Machine English translation of JP 2012-203076 published on Oct. 22, 2012.*

(Continued)

*Primary Examiner* — Billy Lactaoen
(74) *Attorney, Agent, or Firm* — Lucas & Mercanti, LLP

(57) ABSTRACT

An image forming apparatus according to the present invention includes: an opposite roller switching mechanism which switches an opposite roller forming a transfer nip to a second opposite roller of which the outer diameter is different from the outer diameter of a first opposite roller; a paper type information acquirer which acquires the type information of a recording medium used; and a controller which controls the opposite roller switching mechanism based on the type information acquired from the paper type information acquirer.

20 Claims, 9 Drawing Sheets

(56) References Cited

FOREIGN PATENT DOCUMENTS

JP 2012203076 A 10/2012

OTHER PUBLICATIONS

Notification of Reasons for Refusal; Patent Application No. 2014-042863; Dispatch Date: Mar. 8, 2016; Applied Provisions: Article 29(1), Article 29(2), Article 36; total of 6 pages. English translation of Notification of Reasons for Refusal; total of 4 pages; Grand Total of 10 pages.

* cited by examiner

| name of paper | classification of concavities and convexities |
|---|---|
| embossed paper | large |
| plain paper | middle |
| smooth paper | small |

| classification of concavities and convexities | opposite roller |
|---|---|
| large | small-diameter roller (the second opposite roller) |
| small or middle | large-diameter roller (the first opposite roller) |

FIG. 12

| target of evaluation | paper type | outer diameters of the opposite roller (mm)(upper), outer diameter proportions (%) with respect to the secondary transfer roller(lower) | | | | | | | | | | |
|---|---|---|---|---|---|---|---|---|---|---|---|---|
| | | 52 | 48 | 44 | 40 | 36 | 32 | 28 | 20 | 12 | 8 | 6 |
| | | 130% | 120% | 110% | 100% | 90% | 80% | 70% | 50% | 30% | 20% | 15% |
| Image quality (thin line/solid) | Embossed paper | Poor | Poor | Poor | Poor | Fair | Fair | Good | Good | Good | Fair | Fair |
| | Smooth paper | Excellent | Excellent | Excellent | Excellent | Excellent | Excellent | Excellent | Good | Good | Fair | Fair |
| | Plain paper | Fair | Fair | Fair | Good | Good | Excellent | Good | Good | Good | Fair | Fair |
| Separation performance | | Poor | Good | Excellent | Excellent | Excellent | Excellent | Excellent | Excellent | Excellent | Excellent | Excellent |
| Transfer rate | | Excellent | Excellent | Excellent | Excellent | Excellent | Good | Good | Good | Good | Good | Fair |

IMAGE FORMING APPARATUS HAVING OPPOSITE ROLLER SWITCHING AND IMAGE FORMING SYSTEM

CROSS-REFERENCE TO RELATED APPLICATION

This application is based on Japanese Patent Application No. 2014-042863 filed on Mar. 5, 2014, the contents of which are incorporated herein by reference.

BACKGROUND

1. Technical Field

The present invention relates to an electrophotographic image forming apparatus and an image forming system including the electrophotographic image forming apparatus. In particular, the present invention relates to an image forming apparatus and an image forming system, by which a toner image is formed on paper having a surface with concavities and convexities, such as embossed paper.

2. Description of Related Arts

In an image forming apparatus such as an electrophotographic printer or a copying machine, a toner image is formed on an image support such as a photoreceptor, and the formed toner image is transferred onto paper and then fused by heating and pressurization, to thereby obtain the paper on which the toner image is formed.

In recent years, the range of uses of copying machines and printers has been increased, and not only plain paper having a smooth surface but also paper with various kinds of paper quality, including embossed paper having a surface subjected to embossment, has been used. Paper having a surface with prominent concavities and convexities, such as embossed paper, has a problem that a toner transfer property becomes insufficient in concave parts, and the uniformity of an image is deteriorated.

Against such a problem, image forming apparatuses disclosed in Japanese Patent Application Laid-Open No. 2006-267486 (paragraphs 0003 to 0004) and Japanese Patent Application Laid-Open No. 2012-128229 are intended to be improved in transfer property for paper having a surface with prominent concavities and convexities by increasing the transfer pressure of a secondary transfer roller on an intermediate transfer belt.

However, the transfer pressure is increased or decreased by increasing or decreasing a load on the secondary transfer roller in the technologies of the patent literatures described above. Such a configuration in which transfer pressure is increased or decreased by a load is a simple configuration. However, the configuration has had a problem that the variable range of the transfer pressure is narrow, resulting in insufficient improvement in transfer property.

The present invention is achieved in view of the circumstances described above. An object of the present invention is to provide an image forming apparatus capable of improving the transfer property of paper with concavities and convexities, such as embossed paper.

SUMMARY

To achieve at least one of the abovementioned objects, an image forming apparatus reflecting one aspect of the present invention comprises an image former which forms a toner image on an intermediate transfer belt, a secondary transfer roller which transfers the toner image formed on the intermediate transfer belt to a recording medium in a transfer nip, an opposite roller which is placed, to be opposite to the secondary transfer roller, on an inner peripheral surface of the intermediate transfer belt, and forms the transfer nip, an opposite roller switching mechanism which switches the opposite roller which forms the transfer nip between the first opposite roller having a predetermined outer diameter and a second opposite roller having an outer diameter different from the outer diameter of the first opposite roller, a paper type information acquirer which acquires type information of a recording medium used, and a controller which controls the opposite roller switching mechanism based on the type information acquired from the paper type information acquirer.

In the image forming apparatus according to the above, preferably, the second opposite roller has a smaller diameter than the first opposite roller, and the controller allows the first opposite roller to form the transfer nip when judging that a quantity of concavities and convexities on a surface of a recording medium used is not larger than a predetermined quantity, and allows the switched second opposite roller to form the transfer nip when judging that the quantity of concavities and convexities on the surface of the recording medium used is larger than the predetermined quantity.

BRIEF DESCRIPTION OF THE DRAWINGS

FIG. 12 is a table representing correspondence relationships between an outer diameter of an opposite roller 31 (32) and the overall evaluations of transfer properties;

DETAILED DESCRIPTION

Figure 1:
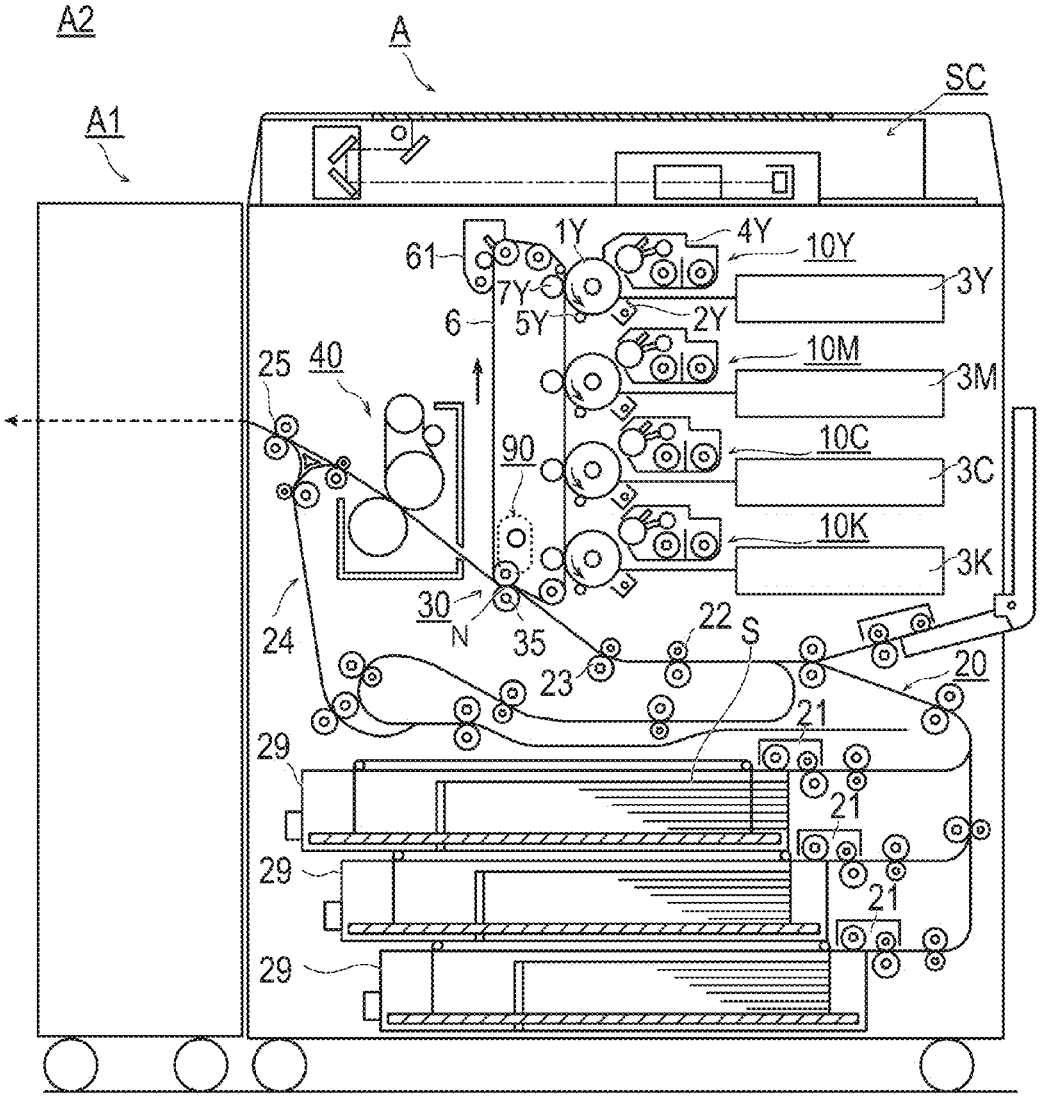
FIG. 1 is a view illustrating the whole of an image forming system A2 including an image forming apparatus A.

Hereinafter, embodiments of the present invention will be described with reference to the accompanying drawings. In the drawings and the present specification, the same elements are denoted by the same reference signs, and redundant description is omitted. In addition, in some cases, dimensional ratios in the drawings are exaggerated and different from actual ratios for convenience of the description.

First Embodiment

Image Forming Apparatus and Image Forming System

Figure 2:
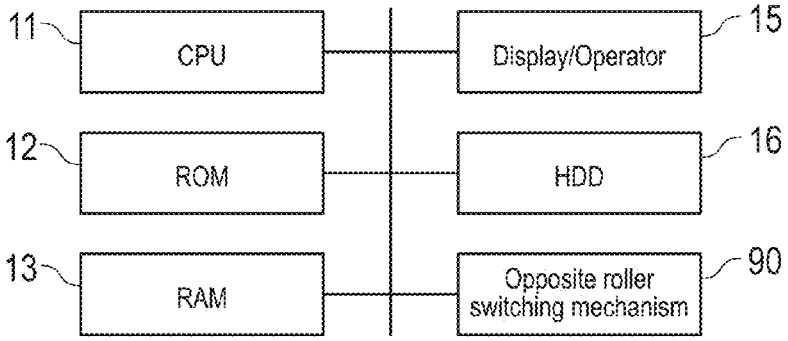
FIG. 2 is a control block diagram of the image forming apparatus A.

An image forming apparatus and an image forming system according to a first embodiment will be described with reference to FIG. 1 and FIG. 2. FIG. 1 is a view illustrating the whole of an image forming system A2 including an image forming apparatus A, and FIG. 2 is a control block diagram of the image forming apparatus A.

The image forming system A2 includes the image forming apparatus A and a post-treatment apparatus A1 linked to the image forming apparatus A. In the image forming apparatus A, an image is formed on paper. In the post-treatment apparatus A1, the paper on which the image is formed is subjected to post-treatment such as staple treatment or punch treatment.

The image forming apparatus A, which is referred to as a tandem-type color image forming apparatus, includes plural sets of image formers 10Y, 10M, 10C, and 10K, an intermediate transfer belt 6 having a belt shape, a paper feeder 20, a fuser 40, and the like.

A scanner SC is placed in an upper portion of the image forming apparatus A. An image in an original put on an original stand is scanned and exposed by an optical system of an original image scanning exposure apparatus of the scanner SC, and is read by a line image sensor. An analog signal that is photoelectrically converted by the line image sensor is subjected to analog processing, A/D conversion, shading compensation, image compression processing, and the like in a controller, and is then input into exposure units 3Y, 3M, 3C, and 3K.

In the present specification, a component is denoted by a reference sign in which an alphabet subscript is omitted when the component is collectively called, and an individual component is denoted by a reference sign to which a subscript Y (yellow), M (magenta), C (cyan), or K (black) is applied.

Each of an image former 10Y which forms a yellow (Y) image, an image former 10M which forms a magenta (M) image, an image former 10C which forms a cyan (C) image, and an image former 10K which forms a black (K) image includes a drum-shaped photoreceptor 1 as an image support, a band electrode 2 placed around the photoreceptor 1, the exposure unit 3, a development apparatus 4, and a cleaning unit 5 (some reference signs are omitted for M, C, and K).

The photoreceptor 1 is, for example, an organic photoreceptor in which a photosensitive layer including a resin containing an organic photoconductor is formed on an outer peripheral surface of a drum-shaped metal substrate. The photoreceptor 1 is disposed in the state of extending in the width direction of transported paper S (direction perpendicular to a paper face in FIG. 1). Examples of the resin included in the photosensitive layer include polycarbonate and the like.

The development apparatus 4 contains a two-component developer including each of small-particle-diameter toners with different colors of yellow (Y), magenta (M), cyan (C), and black (K). The two-component developer includes: a carrier in which the perimeter of ferrite as a core is coated with an insulating resin; and a toner with each color, which contains polyester as a main material, and to which a pigment or a coloring agent such as carbon black, a charge control agent, silica, titanium oxide, and the like are added. The carrier has a particle diameter of 10 to 50 μm and a saturation magnetization of 10 to 80 emu/g. The toner has a particle diameter of 4 to 10 μm. The charging characteristic of the toner is a negative charging characteristic. The toner has an average charge quantity of −20 to −60 μC/g. The two-component developer, in which the carrier and the toner are mixed so that the concentration of the toner is 4 to 10 mass %, is used.

The belt-shaped intermediate transfer belt 6 is rotatably supported by plural rollers. The intermediate transfer belt 6, which is a seamless belt having a volume resistivity of 6 to 12 LOG Ω·cm, is, for example, a semi-conductive seamless belt having a thickness of 0.04 to 0.10 mm, in which a conductive material is dispersed in engineering plastic such as modified polyimide, thermosetting polyimide, ethylene-tetrafluoroethylene copolymer, polyvinylidene fluoride, or nylon alloy.

A primary transfer roller 7 allows a toner image with each color, formed on the photoreceptor 1 of each of the image formers 10Y, 10M, 10C, and 10K by the image former 10Y, 10M, 10C, or 10K, to be consecutively transferred onto the rotating intermediate transfer belt 6 (primary transfer), to form a synthesized color image. In the photoreceptor 1Y, 1M, 1C, or 1K after the image transfer, residual toner is removed by a brush roller of the cleaning unit 5 for each color.

The paper feeder 20 includes paper storage trays 29, first paper feed units 21, paper feed rollers 22, and resist rollers 23. Each of the resist rollers 23 is connected to a clutch, which is not illustrated, and a motor. By controlling the stop and the rotation of the resist rollers 23, the paper S is transported so that the paper S arrives at a transfer nip N in synchronization with timing at which a toner image formed on the intermediate transfer belt 6 arrives at the transfer nip N.

Plural sheets of paper S can be stored in each paper storage tray 29. The stored paper S is fed by the first paper feed units 21, and transported to a secondary transferer 30 located downstream in a transporting direction by the paper feed rollers 22 and the resist rollers 23.

A color image formed on the intermediate transfer belt 6 is transferred onto the paper S transported in the transfer nip N (secondary transfer).

In the fuser 40, heat and pressure are applied to the paper S onto which the color image is transferred, to thereby fix a color toner image on the paper S. Then, the paper is ejected from a paper ejection roller 25 disposed in a paper ejection transportation path, and is placed on a paper ejection tray outside the apparatus through the post-treatment apparatus A1.

In contrast, in the intermediate transfer belt 6, the color image is transferred onto the paper S by the secondary transferer 30, followed by removing residual toner by a belt cleaning unit 61.

In the case of copying on both faces of paper S, an image formed on a first face of the paper S is subjected to fusing treatment, and the paper S is then branched from the paper ejection transportation path by a branch plate, is introduced into a both-face transportation path 24, is flipped from front to back, and is re-transported via the paper feed rollers 22 and the like. A toner image formed on the intermediate transfer belt 6 by the image formers 10Y, 10M, 10C, and 10K is transferred onto a second face of the paper S, and is subjected to heating fusing treatment by the fuser 40, followed by ejecting the paper outside the apparatus by the paper ejection roller 25.

The intermediate transfer belt 6, the belt cleaning unit 61, the primary transfer roller 7, and an opposite roller switching mechanism 90 mentioned later are included in an intermediate transfer unit, and can be integrally removed from the image forming apparatus A during maintenance.

FIG. 2 is a control block diagram of the image forming apparatus A. In this figure, principal portions necessary for explaining the operation of the present embodiment are mainly described, and the other known portions for the image forming apparatus are omitted.

A CPU 11 functions as a controller which executes various kinds of control of the image forming apparatus A according to a program. A ROM 12 stores a program and data for the various kinds of control. A RAM 13 is utilized as a work area for the CPU 11, and temporarily stores a program and data needed when the CPU 11 executes the control of the image forming apparatus A. In addition, the CPU 11 executes the control of the image forming apparatus A based on the program and the data developed in the RAM 12. A display/operator 15 is a display for a liquid crystal screen, and a touch sensor overlapped on the display, or a keyboard and a mouse. The display/operator 15 acquires directions from a user. In the present embodiment, a user can use the display/operator 15 to input the information of paper stored in each paper storage tray 29. As the information of the paper, thick paper, thin paper, or paper thickness information such as a basis weight, as well as the information of specialty paper such as coat paper, embossed paper, or rough paper can also be input. The quantity of concavities and convexities related to such paper is pre-stored in an HDD 16 in association with the information of the specialty paper. The controller, the display/operator 15, the HDD 16, and the like function as means for acquiring paper type information (paper type information acquirer).

The opposite roller switching mechanism 90 is a mechanism which mutually switches an opposite roller to a first opposite roller 31 or a second opposite roller 32. The opposite roller switching mechanism 90 is controlled by the controller.

Figure 3:
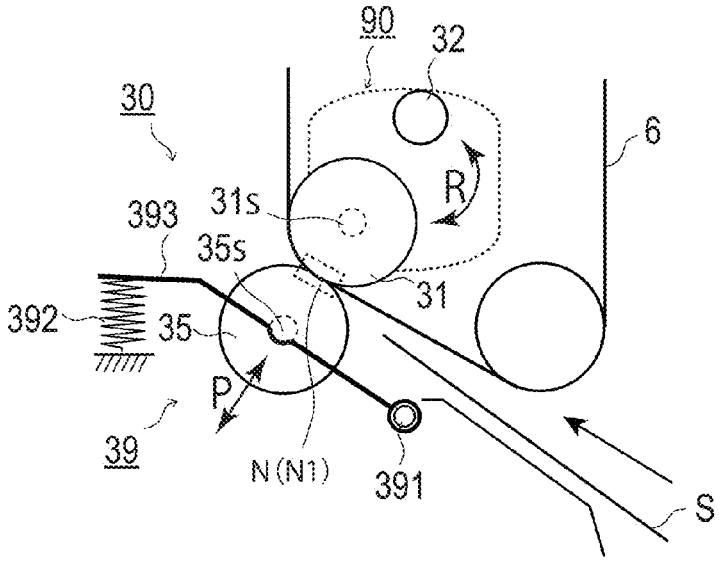
FIG. 3(*a*) and FIG. 3(*b*) are an enlarged view illustrating the neighborhood of a secondary transferer 30, in which FIG. 3(*a*) is a view representing a state in which a first opposite roller is used, and FIG. 3(*b*) is a view representing a state in which a second opposite roller is applied.
Figure 3:
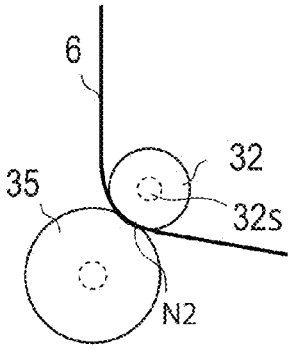

FIG. 3 is an enlarged view illustrating the neighborhood of the secondary transferer 30. FIG. 3(*a*) is a view representing a state in which a transfer nip N1 is formed by the first opposite roller 31 and a secondary transfer roller 35 using the first opposite roller 31 (hereinafter referred to as "state A"). FIG. 3(*b*) is a view representing a state after switching to the second opposite roller 32 by the opposite roller switching mechanism 90 (hereinafter referred to as "state B"). In the state B, a transfer nip N2 is formed by the secondary transfer roller 35 and the second opposite roller 32.

As illustrated in FIG. 3(*a*), the secondary transferer 30 includes: an energization unit 39 including a fulcrum shaft 391, an elastic member 392 such as a spring, and an arm 393; the secondary transfer roller 35; and the like. To both ends of a rotating shaft 35*s* in the secondary transfer roller 35, the energization unit 39 applies a load (N) toward the first opposite roller 31 (or the second opposite roller 32 mentioned later). A designed value of the load is, for example, 80 N. The rotating shaft 35*s* in the secondary transfer roller 35 is a movable shaft that can move in the direction of an arrow P of FIG. 3. In contrast, both of a rotating shaft 31*s* in the first opposite roller 31 and a rotating shaft 32*s* in the second opposite roller 32 (see FIG. 3(*b*)) are fixed shafts in the state A and the state B. A voltage for forming a transfer electric field between the secondary transfer roller 35 and the opposite roller 31 (32) is supplied to the secondary transfer roller 35 or the opposite roller 31 (32) by a high-voltage power supply for secondary transfer (not illustrated).

The outer diameter of the first opposite roller 31 is set at ϕ 40 mm which is equal to that of the secondary transfer roller 35. The outer diameter of the second opposite roller 32 is set to be lower than that of the first opposite roller 31. A preferred range of the outer diameter of the second opposite roller 32 is 20% or more and 90% or less with respect to that of the first opposite roller 31 or the secondary transfer roller 35, and a more preferred range thereof is 30% or more and 70% or less.

As the first opposite roller 31 and the second opposite roller 32, both of which have a material of NBR (Nitrile Butadiene Rubber), rollers having equivalent resistance values are used. A range of such a resistance value is 5 to 10 LOG Ω. As for rubber hardness, there is used a material in which the rubber hardness of the second opposite roller 32 is equivalent to or higher than the rubber hardness of the first opposite roller 31. For example, the rubber hardness of the first opposite roller 31 is 60° (Asker-C) while the rubber hardness of the second opposite roller 32 having a small diameter is 60° or 70° (Asker-C).

Opposition Roller Switching Mechanism 90

Figure 4:
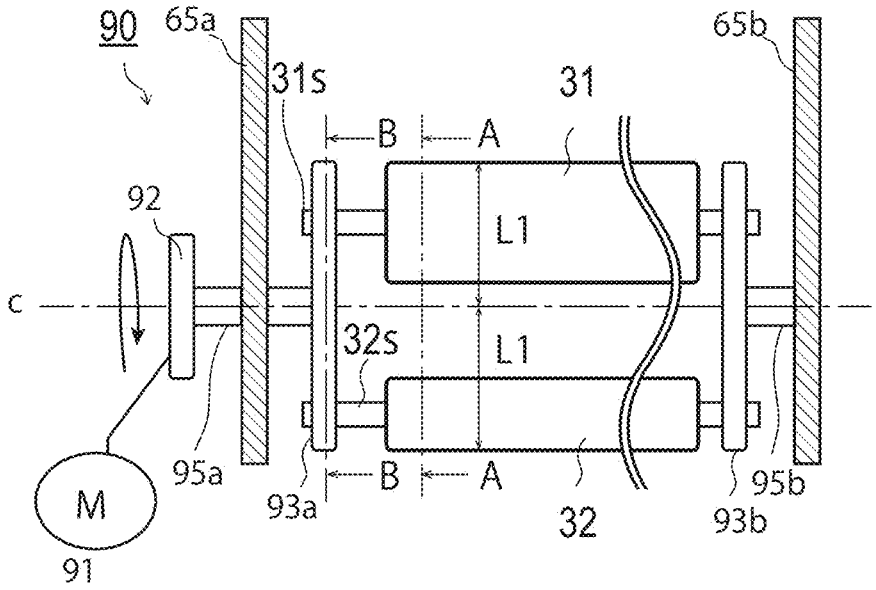
FIG. 4 is a view for explaining an opposite roller switching mechanism.
Figure 5:
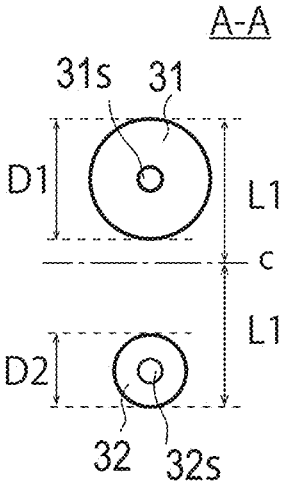
FIG. 5(*a*) is a cross-sectional view taken along the line A-A of FIG. 4, and FIG. 5(*b*) is a cross-sectional view taken along the line B-B of FIG. 4.
Figure 5:
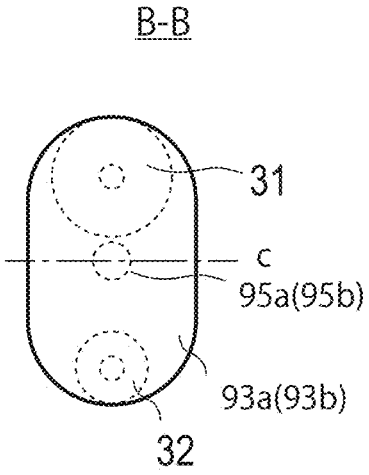

FIG. 4 and FIG. 5 are views for explaining the configuration of the opposite roller switching mechanism 90. The opposite roller switching mechanism 90 is attached to panels 65*a* and 65*b* disposed in the front and back of the intermediate transfer unit (front-back direction of a paper face of FIG. 1), respectively. Roller holders 93*a* and 93*b* are attached to an upstream rotating shaft 95*a*, connected to an input gear 92 into which driving is input, and a rotating shaft 95*b* opposite to the rotating shaft 95*a*, respectively. The rotating shafts 31*s* and 32*s* included in the first opposite roller 31 and the second opposite roller 32, respectively, are rotatably attached to the roller holders 93*a* and 93*b* via a not-illustrated bearing. Each opposition roller is rotated with rotation of the intermediate transfer belt 6 by coupled driving. The roller holders 93*a* and 93*b* and the first and second opposite rollers 31 and 32 are integrally rotated about the rotating shafts 95*a* and 95*b* in a direction indicated by an arrow R (see FIG. 3) by transmitting driving from a drive motor 91 disposed on a main body of the Image forming apparatus A to the input gear 92. FIG. 3(*b*) represents a state in the case of rotation at 180 degrees from FIG. 3(*a*). In FIG. 3(*b*), the transfer nip N2 is formed by the second opposite roller 32. After movement to the state A of FIG. 3(*a*) or the state B of FIG. 3(*b*), the rotating shaft 31*s* or the rotating shaft 32*s* are fixed by stopping rotation by a clutch mechanism which is not illustrated, and the like.

FIG. 5(*a*) is a cross-sectional view taken along the line A-A of FIG. 4, and FIG. 5(*b*) is a cross-sectional view taken along the line B-B of FIG. 4. Reference sign c denotes a central line, which corresponds to the center of the rotating shaft 95*a* or 95*b*. Reference signs D1 and D2 denote the diameters of the first opposite roller 31 and the second opposite roller 32, respectively. As illustrated in the figures above, a distance L1 to the farthest position on the circumference of the first opposite roller 31 from the central line c, and a distance L1 to the farthest position on the circumference of the second opposite roller 32 from the central line c are set to be the same distance in view of design.

Figure 6:
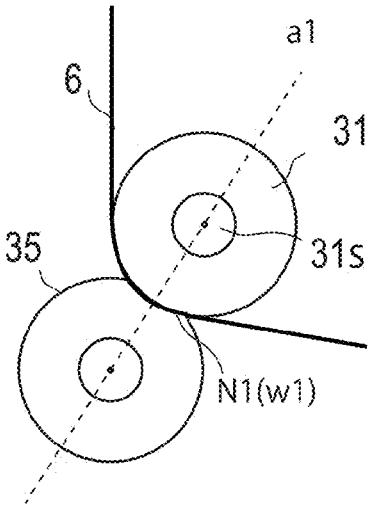
FIG. 6(*a*) and FIG. 6(*b*) are illustrating a positional relationship, in view of design, between a first opposite roller and a second opposite roller, which form a transfer nip.
Figure 6:
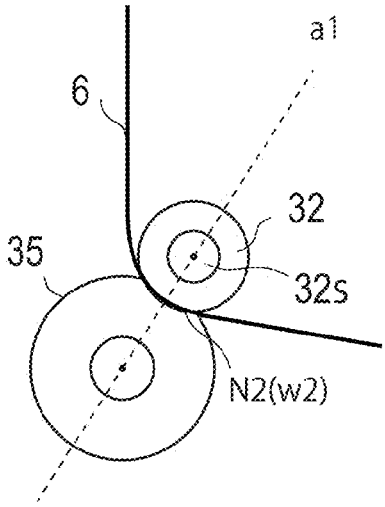
Figure 7:
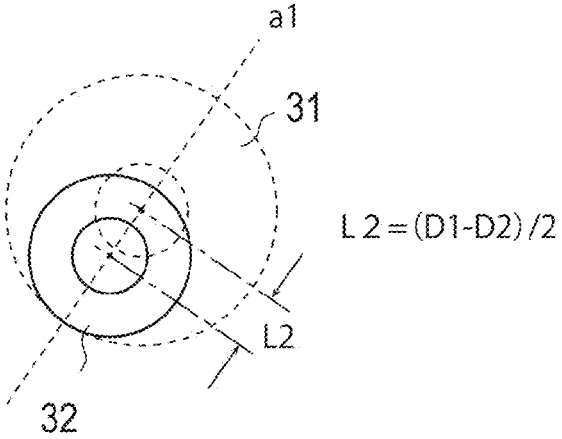
FIG. 7 is a view illustrating a positional relationship, in view of design, between a first opposite roller and a second opposite roller, which form a transfer nip.

FIG. 6 and FIG. 7 represent the configuration relationships between the rotating shafts 31*s* and 32*s* in view of design in the state A in which the first opposite roller 31 is used as an opposite roller forming a transfer nip and in the state B of switching to the second opposite roller 32, respectively. FIGS. 6 and 7 are views observed from the directions of the rotating shafts.

Both of a line between the center of the secondary transfer roller 35 and the center of the first opposite roller 31 in the state A as illustrated in FIG. 6(*a*) and a line between the center of the secondary transfer roller 35 and the center of the second opposite roller 32 in the state B as illustrated in FIG. 6(*b*) are on the same virtual line a1.

Further, the circle (perimeter) of the second opposite roller 32 in the state B is designed to internally touch the circle (perimeter) of the first opposite roller 31 in the state A as illustrated in FIG. 7. Specifically, the center of the second opposite roller 32 in the state B is designed to be located at a location closer to the secondary transfer roller 35 than the center of the first opposite roller 31 in the state A by a distance L2. L2 is the difference value between the radii of both rollers (L2=(D1−D2)/2)). In such a manner, the positions of the centers of the transfer nips N in a width direction in both state A and state B are at the same position in view of design. As a result, (1) a load (N) in the transfer nip by the energization unit 39 can be allowed to be constant since the abutment position of the secondary transfer roller 35 is unchanged. (2) In addition, the pathway of transportation of paper S to the transfer nip N can be allowed to be the same, and an image forming distance (distance from an exposure position to a transfer nip position) can be allowed to be constant.

As described above, loads, in the transfer nip N, generated by the energization unit 39 in both state A (first opposite roller) and state B (second opposite roller) are similar (for example, 80 N). In addition, the axial lengths of the transfer nip N in the state A and the state B are equal. Therefore, linear pressures (N/m) in both states are set at approximately equivalent pressures. Therefore, a transfer nip width w2 which is the length of the transfer nip N2 in a circumferential direction in the state B is less than the transfer nip width w1 of the transfer nip N1 in the state A. In other words, pressure in the transfer nip N2 in the state B is set to be higher than pressure ($N/m^2$) in the transfer nip N1 in the state A.

The increased rubber hardness of the second opposite roller 32 can result in the less transfer nip width w2 and therefore in higher pressure in the transfer nip N2. An example in which the second opposite roller 32 of which the diameter is smaller than that of the first opposite roller 31 is used is explained in the first embodiment. In addition to the example, further, both opposition rollers may be allowed to have an equal diameter, and the rubber hardness of the second opposite roller 32 may be higher than the rubber hardness of the first opposite roller 31. Thus, transfer nip width w2<transfer nip width w1 is further satisfied, and therefore, pressure in the transfer nip N2 can be further allowed to be higher than pressure in the transfer nip N1.

Control Flow

Figures 8, 9:
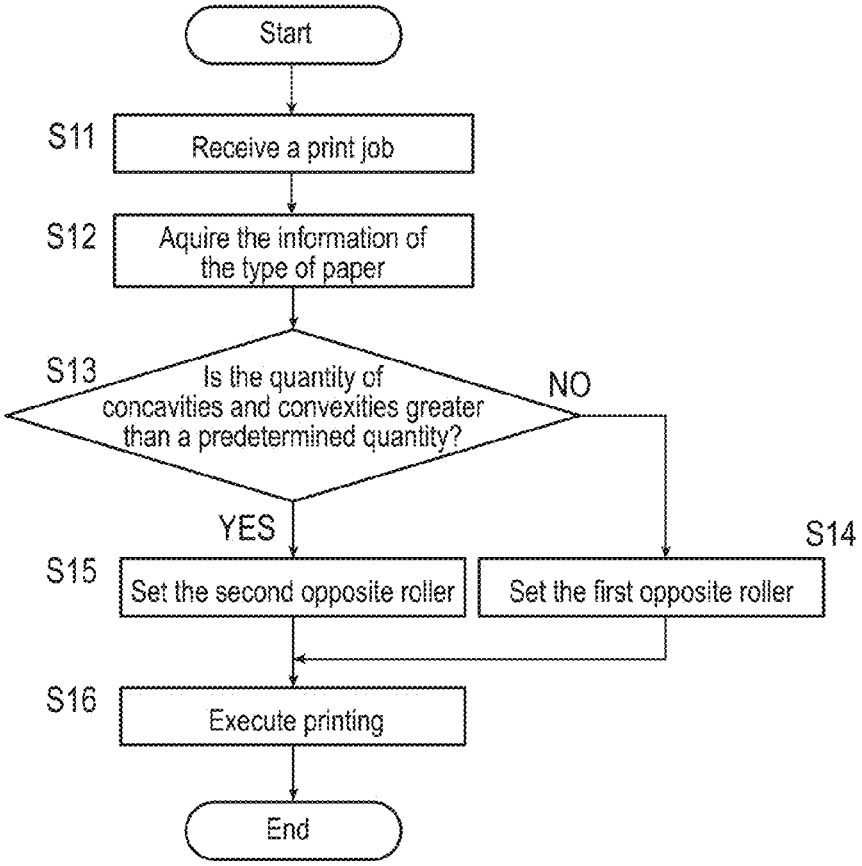
FIG. 8 is a view representing a control flow executed by a controller.
FIG. 9(*a*) and FIG. 9(*b*) are examples of a control table.

FIG. 8 is a view representing a control flow executed by the controller.

When a print job is received in step S11, the printing setting of the received print job is analyzed to acquire the information of the type of paper to be used for printing in step S12. Specifically, paper type information set in a paper storage tray 29 selected in the printing setting is acquired from the HDD 16, and an index value of the quantity of concavities and convexities, associated with the acquired paper type information, is acquired. FIG. 9 is a table example representing a relationship between a paper type stored in the HDD 16 and an index value of the quantity of concavities and convexities. For example, when embossed paper such as LEATHAC 66 (trade name) from Tokushu Tokai Paper Co., Ltd. is stored in a paper storage tray, and a printing setting has a content in which the embossed paper is used, the controller refers to a table as in FIG. 9(*a*) can recognize paper to be used as paper having concavities and convexities classified as "large".

In step S13, it is judged whether or not the index value of the quantity of concavities and convexities acquired in step S12 is greater than a predetermined quantity "middle". In the case of a printing setting in which paper of which the index value is "middle" or "small", such as plain paper or smooth paper, is used as listed in the table of FIG. 9(*b*), judgment as NO is carried out in step S13, and the first opposite roller 31 having a large diameter is selected. In next step S14, switching to the first opposite roller 31 is carried out by the opposite roller switching mechanism 90 when a current situation is in the state B (second opposite roller). When the current situation is in the state A (first opposite roller), the first opposite roller 31 is just set.

In contrast, in the case of a printing setting in which paper, of which the index value of the quantity of concavities and convexities is "large", such as embossed paper, is used, judgment as YES is carried out in step S13, and the second opposite roller 32 of which the diameter is smaller than that of the first opposite roller 31 is selected.

In next step S15, switching from the first opposite roller 31 to the second opposite roller 32 is carried out by the opposite roller switching mechanism 90 when a current situation is in the state A. When the current situation is in the state B, the second opposite roller 32 is just set.

In step S16, printing is executed using the opposite roller set in step S14 or step S15, and an end is put.

Effects

Figure 10:
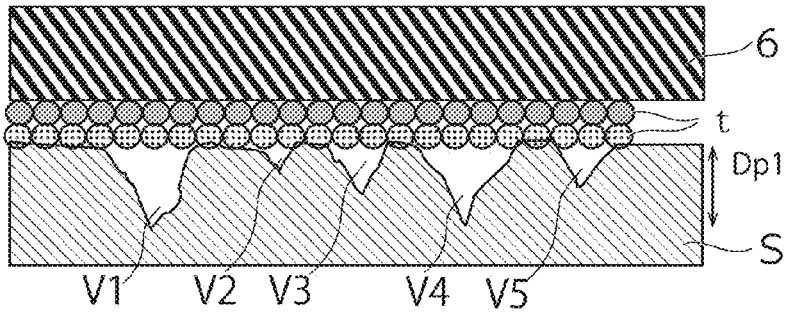
FIG. 10(*a*) and FIG. 10(*b*) are a schematic view for explaining a mechanism in which poor transfer occurs in the case of using paper having a surface with concavities and convexities, such as embossed paper, in which FIG. 10(*a*) represents the state of paper S in a transfer nip N in a comparative example, and FIG. 10(*b*) represents the state of the paper S immediately after having passed through the transfer nip N.
Figure 10:
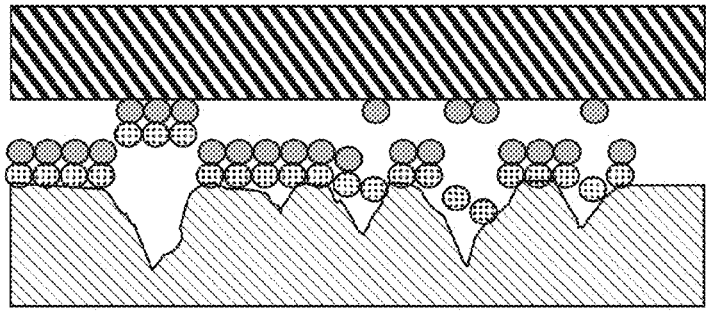
Figure 11:
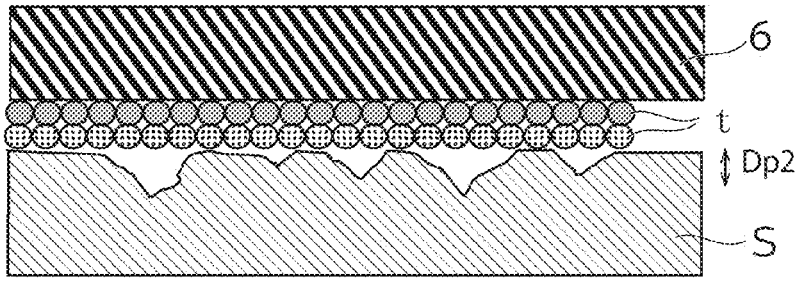
FIG. 11(*a*) represents the state of paper S in a transfer nip N in an example, and FIG. 11(*b*) represents the state of the paper S immediately after having passed through the transfer nip N.
Figure 11:
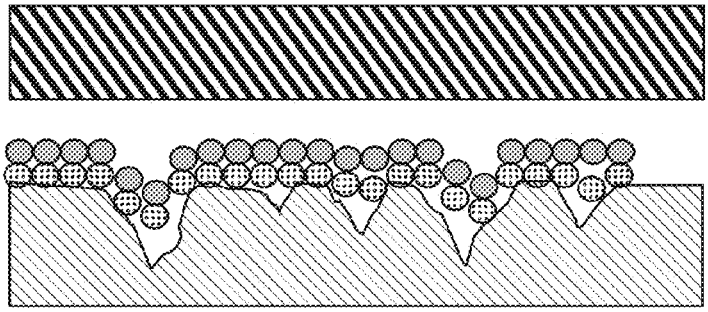

In the image forming apparatus according to the present embodiment and the image forming system including the image forming apparatus, an image of high quality can be formed since transfer even to a recording medium having a surface with concavities and convexities, such as embossed paper, can be well carried out by switching to the second opposite roller of which the outer diameter is different from that of the first opposite roller by the opposite roller switching mechanism. Effects by the present embodiment will be described in more detail below with reference to FIG. 10 and FIG. 11. Both FIG. 10 and FIG. 11 are schematic views for explaining a secondary transfer process of paper having a surface with concavities and convexities, such as embossed paper, in the transfer nip N. FIG. 10(*a*) and FIG. 11(*a*) represent the state of the paper in the transfer nip N, and FIG. 10(*b*) and FIG. 11(*b*) represent the state of the paper immediately after having passed through the transfer nip N. FIG. 10 is a view representing the state of transfer in the state A (first opposite roller 31) as a comparative example, and FIG. 11 is a view representing the state of transfer at higher nip pressure in the state B (second opposite roller 32) as an example according to the present invention.

As illustrated in FIG. 10, depressions (for example, V1 to V5) exist on a surface of paper S with great concavities and convexities. The maximum value of the depths Dp1 of the depressions is approximately around 80 μm, which is high compared to the particle diameters (4 to 10 μm) of toner t. In the transfer nip N1, the depressions V (V1 to V5) of the paper S prevent the toner from coming into contact with the surface of the paper S, and results in existence of spaces. When the spaces are large, the toner t on the intermediate transfer belt 6 does not come into contact with the paper surface, and pressure does not act on the toner t. Therefore, transfer is carried out only by force acting on the toner t due to a transfer electric field formed between the intermediate transfer belt 6 and the paper S. In the depressions V in which the spaces are generated, a formed transfer electric field in itself, which is weak, results in insufficient transfer in the depression V on the paper S, and in remaining of a transfer residue on the intermediate transfer belt 6. Therefore, concentration is decreased in the regions of the depressions V on the paper surface, and a defectiveness image seeming to have white dropouts is generated (FIG. 10(*b*)).

In contrast, the width of the transfer nip N2 can be reduced by switching an opposite roller from the first opposite roller 31 to the second opposite roller 32 of which the diameter is smaller than that of the first opposite roller 31, as illustrated in FIG. 11. For example, the width of the transfer nip N can be approximately halved by halving an outer diameter. Therefore, pressure ($N/m^2$) in the transfer nip N2 can be allowed to be inverse time a transfer nip width ratio, for example, can be doubled, even if the secondary transfer roller 35 is energized toward the opposite roller at the same load by the energization unit 39. As a result, the concavities and the convexities on the paper surface can be pressed to be small (low) by large pressure in the transfer nip N2. FIG. 11(*a*) is a schematic view representing such a state. As illustrated in this figure, the depths Dp2 of depressions V can be reduced compared to the depths Dp1 in FIG. 10 by the increased pressure. As a result, the toner t on the intermediate transfer belt 6 can be brought into contact with the depressions V of the paper S, and the spaces are narrowed, whereby a transfer electric field in itself is increased, to thereby enable improvement in transfer properties (FIG. 11(*b*)).

Examples

Next, the appropriate ranges of the outer diameters of a first opposite roller and a second opposite roller will be described based on specific examples of the present application. FIG. 12 is a table representing correspondence relationships between the outer diameter of the opposite roller 31 (32) and the overall evaluations of transfer properties. As the opposite roller 31 (32), opposite rollers having different eleven outer diameters which are outer diameters ϕ of 6, 8, 12, 20, 28, 32, 36, 40, 44, 48, and 52 mm are used. The outer diameter of the secondary transfer roller 35 is ϕ 40 mm. In the table of FIG. 12, outer diameter proportions (%) with respect to the secondary transfer roller 35 are also listed.

The other conditions are as described below.

(Image Forming Apparatus A)

Intermediate transfer belt 6: material: polyimide, resistivity of 11.0 LOG Ω/sq, thickness of 100 μm Secondary transfer roller 35: NBR, rubber hardness of 70° (Asker-C), resistance value of 7.5 LOG Ω

Opposite roller 31 (32): resistance value of 7.5 LOG Ω, rubber hardness of 70° (Asker-C)

Transfer nip N: pressing load of 80 N, axial length of nip of 340 mm (Paper Used)

Embossed paper: LEATHAC 66, manufactured by Tokushu Tokai Paper Co., Ltd., basis weight of 203 gsm Plain paper: HAMMERMILL TIDAL MP Smooth paper: POD GLOSS COAT, manufactured by Oji Paper Co., Ltd., 128 gsm (Evaluation Method)

Image quality (thin line): A dropout was evaluated by visual observation in an output image with 1200 dpi and 8-dot lines.

Image quality (solid): A white dropout or the like was evaluated by visual observation in an output image with a blue solid image.

Separation performance: Separation performance was evaluated using NPI premium grade paper (52.3 gsm) manufactured by Nippon Paper Industries Co., Ltd.

Transfer rate: A measurement result of a toner transfer rate (toner mass ratio before and after transfer) of a solid image was evaluated.

(Results)

The results are described in FIG. 12. In the figure above, "Excellent" represents no problem, "Good" represents occurrence of minor defectiveness at a level with no problem, "Fair" represents occurrence of minor defectiveness at a level with any problem, and "Poor" represents occurrence of defectiveness of at a level with any problem.

For example, at a roller diameter ratio of 100% of embossed paper, a transfer property for the concave portions (depression portions) of the embossed paper is insufficient, a white dropout phenomenon occurs, and image quality has a problem (see FIG. 12). When the ratio is 130% or more, poor separation is prone to occur in thin paper. In contrast, when the ratio is 80% or less, overall transfer rates are decreased. Further, when the ratio is 20% or less, peak pressure is excessively increased, a dropout is prone to occur, and the reproducibility of a thin line is deteriorated.

Based on the experimental results as listed in FIG. 12, it was judged that the preferred appropriate range of the ratio of the outer diameter of the second opposite roller 32 applied to paper with great concavities and convexities, such as embossed paper, to the outer diameter of the secondary transfer roller 35 is 20% or more and 90% or less. It was judged that within the range, particularly, a range of 30% or more and 70% or less is a more preferred appropriate range because of a result of "Good".

It was also judged that a preferred appropriate ratio for the first opposite roller 31 applied to paper except paper with great concavities and convexities is 90% or more and 110% or less.

In the first embodiment described above, the example in which the number of the first opposite roller 31 or the second opposite roller 32 is one is described. However, without limitation to the example, for example, plural second opposite rollers may be used so that an opposite roller having a dimension with an outer diameter between a first opposite roller 31 corresponding to "middle" in the classification of concavities and convexities, described in FIG. 9, and a second opposite roller 32 which is first may be disposed, and the opposite roller is a second opposite roller which is second.

Second Embodiment

A second embodiment will be described with reference to FIG. 13 to FIG. 15.

As a second opposite roller 32, a roller having a small diameter is used. However, when the outer diameter of the roller is reduced, rigidity can be deteriorated, bending can easily occur in a case in which the roller receives a pressing load from an energization unit 39, and necessary pressure may be prevented from being obtained in a transfer nip N2. In the second embodiment, a backup member abutting from a side opposite to the transfer nip N2 is disposed on the outer peripheral surface of the second opposite roller 32. In the second embodiment as a specific embodiment, a first opposite roller 31 functions as the backup member.

Figure 13:
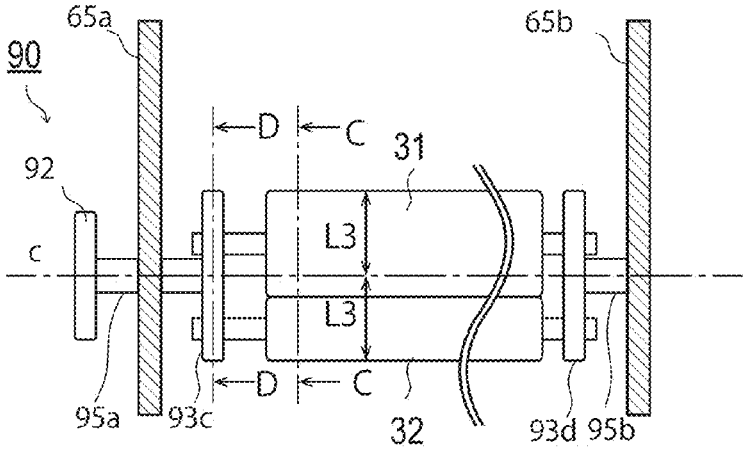
FIG. 13 is a view for explaining an opposite roller switching mechanism in a second embodiment.
Figure 14:
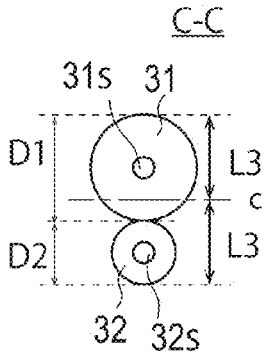
FIG. 14(*a*) is a cross-sectional view taken along the line C-C of FIG. 13, and FIG. 14(*b*) is a cross-sectional view taken along the line D-D of FIG. 13.
Figure 14:
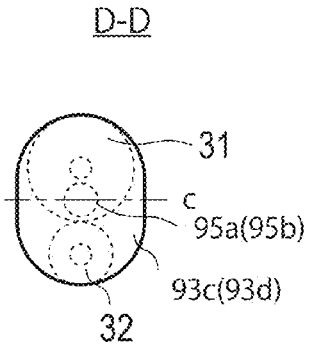
Figure 15:
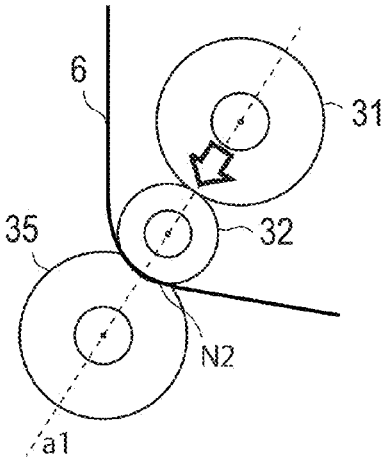
FIG. 15 is a view for explaining a first opposite roller 31 functioning as a backup member in the second embodiment.

FIG. 13 and FIG. 14 correspond to FIG. 4 and FIG. 5, respectively. In the second embodiment, the same components as those in the first embodiment are denoted by the same reference signs, rather than explained.

In the second embodiment, a distance L3 to the farthest position on the circumference of the first opposite roller 31 from the central line c, and a distance L3 to the farthest position on the circumference of the first opposite roller 32 from the central line c on the circumference of the second opposite roller 32 to the farthest position are set at the equal distances in view of design. Further, the double of L3 is set to be equal to the total of diameters D1 and D2 (L3×2=D1+D2), as illustrated in the figures above. Thus, the first opposite roller 31 and the second opposite roller 32 attached to roller holders 93*c* and 93*d* circumscribe each other. Such setting can prevent the second opposite roller 32 from being bent since the second opposite roller 32 receives reaction force from the first opposite roller 31, as represented by an arrow in FIG. 15, even if the second opposite roller 32 is going to be bent by the pressing force of the secondary transfer roller 35 energized by the energization unit 39 as illustrated in FIG. 15. As a result, the transfer nip N2 can be set at pressure ($N/m^2$) equal to a designed value, and therefore, good transfer can be made even on a recording medium with concavities and convexities.

Third Embodiment

Figure 16:
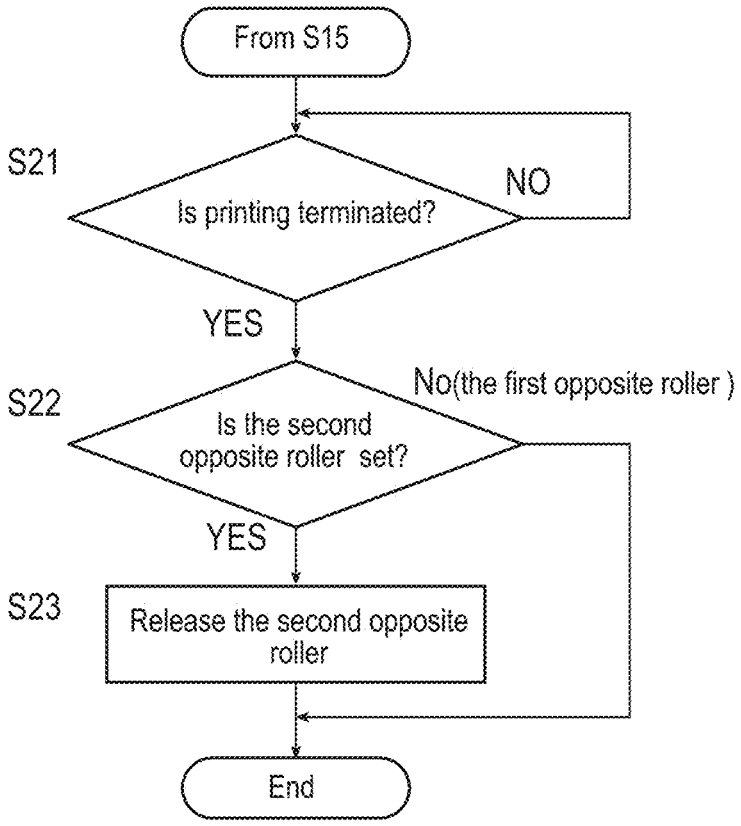
FIG. 16 is a view representing a control flow executed by a controller in a third embodiment.

Next, a third embodiment will be described with reference to FIG. 16. FIG. 16 represents a flow from S15 (or S14) of FIG. 8. The flow other than the flow represented in FIG. 16 is similar to that of the first embodiment, and the explanation thereof is omitted.

A second opposite roller 32 is a small-diameter roller. When the second opposite roller 32 is left standing for a long term in a state in which an intermediate transfer belt 6 is wound around the small-diameter roller, creep deformation easily occurs in the intermediate transfer belt 6. Such creep deformation easily occurs particularly when a roller having a small diameter of 8 mm, 6 mm, or the like as represented in FIG. 9 is applied and is left standing in a high-temperature environment for long time while applying tension to the roller. The third embodiment prevents the creep deformation.

When printing is terminated (YES) in step S21, it is judged in step S22 whether or not the second opposite roller 32 is set as an opposite roller (i.e., whether or not to be in a state B). In the case of NO, processing is unnecessary, and therefore, an end is just put.

In contrast, in the case of YES, the second opposite roller 32 is released in step S23. Two methods for releasing the second opposite roller can be chiefly considered as follows:
(1) switching to a first opposite roller 31 (state A); and
(2) loosening the tension of the intermediate transfer belt 6.
The methods can be achieved by retracting any of plural rollers supporting the intermediate transfer belt 6. For example, an opposite roller switching mechanism 90 is stopped at a position in middle of swinging from the state B to state A at 180 degrees. As a result, both second opposite roller 32 and first opposite roller 31 can be spaced from the intermediate transfer belt 6, and therefore, tension can be loosened.

According to the third embodiment, even in the case of using the second opposite roller 32 having a small diameter, the creep deformation of the intermediate transfer belt 6 due to the case can be prevented.

In the present embodiment, an example in which a secondary transfer roller 35 is used is described as the configuration of a secondary transferer 30. However, without limitation to the example, there may be made a transfer-belt-system secondary transferer in which a roller is placed at a position opposed to the first and second opposite rollers, to wind an endless belt around the roller.

What is claimed is:

1. An image forming apparatus comprising:

an image former which forms a toner image on an intermediate transfer belt;

a secondary transfer roller which transfers the toner image formed on the intermediate transfer belt to a recording medium in a transfer nip;

an opposite roller which is placed, to be opposite to the secondary transfer roller, on an inner peripheral surface of the intermediate transfer belt, and forms the transfer nip;

an opposite roller switching mechanism which switches the opposite roller which forms the transfer nip to a first opposite roller having a predetermined outer diameter or a second opposite roller having an outer diameter different from the outer diameter of the first opposite roller;

a paper type information acquirer which acquires type information of a recording medium used; and a controller which controls the opposite roller switching mechanism based on the type information acquired from the paper type information acquirer, wherein a nip width w2 of a transfer nip N2 formed between the second opposite roller and the secondary transfer roller is allowed to be smaller than a nip width w1 of a transfer nip N1 formed between the first opposite roller and the secondary transfer roller, whereby pressure ($N/m^2$) of the transfer nip N2 is set to be higher than pressure ($N/m^2$) of the transfer nip N1, and the controller allows the first opposite roller to form the transfer nip when judging that a quantity of concavities and convexities on a surface of a recording medium used is not larger than a predetermined quantity, and allows the switched second opposite roller to form the transfer nip when judging that the quantity of concavities and convexities on the surface of the recording medium used is larger than the predetermined quantity.

2. The image forming apparatus according to claim 1, wherein the second opposite roller has a smaller diameter than the first opposite roller; and the controller allows the first opposite roller to form the transfer nip when judging that a quantity of concavities and convexities on a surface of a recording medium used is not larger than a predetermined quantity, and allows the switched second opposite roller to form the transfer nip when judging that the quantity of concavities and convexities on the surface of the recording medium used is larger than the predetermined quantity.

3. The image forming apparatus according to claim 1, wherein a load between the first opposite roller and the secondary transfer roller is designed to be equal to a load between the second opposite roller and the secondary transfer roller after switching.

4. The image forming apparatus according to claim 1, wherein a center of a shaft of the second opposite roller after switching is located on a line between a center of a shaft of the first opposite roller forming the transfer nip and a center of a shaft of the secondary transfer roller.

5. The image forming apparatus according to claim 4, wherein a perimeter of the second opposite roller after switching is designed to internally touch a perimeter of the first opposite roller forming the transfer nip when viewed from a direction of a rotating shaft.

6. The image forming apparatus according to claim 1, wherein a proportion of an outer diameter of the first opposite roller to an outer diameter of the secondary transfer roller is 90% or more and 110% or less.

7. The image forming apparatus according to claim 6, wherein a proportion of an outer diameter of the second opposite roller to an outer diameter of the secondary transfer roller is 20% or more and 90% or less.

8. The image forming apparatus according to claim 7, wherein a proportion of an outer diameter of the second opposite roller to an outer diameter of the secondary transfer roller is 30% or more and 70% or less.

9. The image forming apparatus according to claim 1, wherein formation of an image is finished, and the controller then controls the opposite roller switching mechanism to thereby allow the second opposite roller, of which a diameter is smaller than that of the first opposite roller, to be in a state of being spaced from the intermediate transfer belt.

10. An image forming system comprising:

an image forming apparatus which forms an image on paper; and a post-treatment apparatus which subjects the paper, on which the image is formed, to post-treatment, wherein the image forming apparatus comprises:

an image former which forms a toner image on an intermediate transfer belt;

a secondary transfer roller which transfers the toner image formed on the intermediate transfer belt to a recording medium in a transfer nip;

an opposite roller which is placed, to be opposite to the secondary transfer roller, on an inner peripheral surface of the intermediate transfer belt, and forms the transfer nip;

an opposite roller switching mechanism which switches the opposite roller which forms the transfer nip to a first opposite roller having a predetermined outer diameter or a second opposite roller having an outer diameter different from the outer diameter of the first opposite roller;

a paper type information acquirer which acquires type information of a recording medium used; and a controller which controls the opposite roller switching mechanism based on the type information acquired from the paper type information acquirer, wherein a nip width w2 of a transfer nip N2 formed between the second opposite roller and the secondary transfer roller is allowed to be smaller than a nip width w1 of a transfer nip N1 formed between the first opposite roller and the secondary transfer roller, whereby pressure ($N/m^2$) of the transfer nip N2 is set to be higher than pressure ($N/m^2$) of the transfer nip N1, and the controller allows the first opposite roller to form the transfer nip when judging that a quantity of concavities and convexities on a surface of a recording medium used is not larger than a predetermined quantity, and allows the switched second opposite roller to form the transfer nip when judging that the quantity of concavities and convexities on the surface of the recording medium used is larger than the predetermined quantity.

11. The image forming system according to claim 10, wherein the second opposite roller has a smaller diameter than the first opposite roller; and the controller allows the first opposite roller to form the transfer nip when judging that a quantity of concavities and convexities on a surface of a recording medium used is not larger than a predetermined quantity, and allows the switched second opposite roller to form the transfer nip when judging that the quantity of concavities and convexities on the surface of the recording medium used is larger than the predetermined quantity.

12. The image forming system according to claim 10, wherein a load between the first opposite roller and the secondary transfer roller is designed to be equal to a load between the second opposite roller and the secondary transfer roller after switching.

13. The image forming system according to claim 10, wherein a center of a shaft of the second opposite roller after switching is located on a line between a center of a shaft of the first opposite roller forming the transfer nip and a center of a shaft of the secondary transfer roller.

14. The image forming system according to claim 13, wherein a perimeter of the second opposite roller after switching is designed to internally touch a perimeter of the first opposite roller forming the transfer nip when viewed from a direction of a rotating shaft.

15. An image forming apparatus comprising:

an image former which forms a toner image on an intermediate transfer belt;

a secondary transfer roller which transfers the toner image formed on the intermediate transfer belt to a recording medium in a transfer nip;

an opposite roller which is placed, to be opposite to the secondary transfer roller, on an inner peripheral surface of the intermediate transfer belt, and forms the transfer nip;

an opposite roller switching mechanism which switches the opposite roller which forms the transfer nip to a first opposite roller having a predetermined outer diameter or a second opposite roller having an outer diameter different from the outer diameter of the first opposite roller;

a paper type information acquirer which acquires type information of a recording medium used; and a controller which controls the opposite roller switching mechanism based on the type information acquired from the paper type information acquirer, wherein the second opposite roller has a smaller diameter than the first opposite roller, and the controller allows the first opposite roller to form the transfer nip when judging that a quantity of concavities and convexities on a surface of a recording medium used is not larger than a predetermined quantity, and allows the switched second opposite roller to form the transfer nip when judging that the quantity of concavities and convexities on the surface of the recording medium used is larger than the predetermined quantity.

16. The image forming apparatus according to claim 15, wherein hardness of the second opposite roller is higher than hardness of the first opposite roller.

17. The image forming apparatus according to claim 15, further comprising a backup member abutting on an outer peripheral surface of the second opposite roller forming the transfer nip from an opposite side to the transfer nip.

18. The image forming apparatus according to claim 17, wherein the backup member is the first opposite roller.

19. An image forming system comprising:

an image forming apparatus which forms an image on paper; and a post-treatment apparatus which subjects the paper, on which the image is formed, to post-treatment, wherein the image forming apparatus comprises:

an image former which forms a toner image on an intermediate transfer belt;

a secondary transfer roller which transfers the toner image formed on the intermediate transfer belt to a recording medium in a transfer nip;

an opposite roller which is placed, to be opposite to the secondary transfer roller, on an inner peripheral surface of the intermediate transfer belt, and forms the transfer nip;

an opposite roller switching mechanism which switches the opposite roller which forms the transfer nip to a first opposite roller having a predetermined outer diameter or a second opposite roller having an outer diameter different from the outer diameter of the first opposite roller;

a paper type information acquirer which acquires type information of a recording medium used; and a controller which controls the opposite roller switching mechanism based on the type information acquired from the paper type information acquirer, wherein the second opposite roller has a smaller diameter than the first opposite roller, and the controller allows the first opposite roller to form the transfer nip when judging that a quantity of concavities and convexities on a surface of a recording medium used is not larger than a predetermined quantity, and allows the switched second opposite roller to form the transfer nip when judging that the quantity of concavities and convexities on the surface of the recording medium used is larger than the predetermined quantity.

20. The image forming system according to claim 19, wherein hardness of the second opposite roller is higher than hardness of the first opposite roller.

* * * * *